US008814653B2

(12) United States Patent
Shortino

(10) Patent No.: US 8,814,653 B2
(45) Date of Patent: Aug. 26, 2014

(54) GAME APPARATUS AND METHOD OF CONDUCTING A GAME

(75) Inventor: Michael J. Shortino, Blue Springs, MO (US)

(73) Assignee: Singo Bingo, Inc., Miami, FL (US)

( * ) Notice: Subject to any disclaimer, the term of this patent is extended or adjusted under 35 U.S.C. 154(b) by 170 days.

(21) Appl. No.: 13/559,682

(22) Filed: Jul. 27, 2012

(65) Prior Publication Data

US 2013/0196735 A1 Aug. 1, 2013

Related U.S. Application Data

(60) Provisional application No. 61/513,309, filed on Jul. 29, 2011.

(51) Int. Cl.
*A63F 9/24* (2006.01)

(52) U.S. Cl.
USPC ..... 463/19; 463/22; 705/51; 705/57

(58) Field of Classification Search
USPC ..... 463/19, 22; 705/51, 57
See application file for complete search history.

(56) References Cited

U.S. PATENT DOCUMENTS

2008/0059891 A1* 3/2008 Herzog ..... 715/751
2008/0059991 A1* 3/2008 Romano ..... 725/19

OTHER PUBLICATIONS https://web.archive.org/web/20090310035634/http://www.musicbingo.com/pages/highlight_of_the_weekpag.html.
https:/web.archive.org/web/20041205181609/http://musicbingo.com/pages/highlight_of_the_weekpag.html.

* cited by examiner

*Primary Examiner* — Pierre E Elisca
(74) *Attorney, Agent, or Firm* — Robinson IP Law, PLLC

(57) ABSTRACT

Various embodiments of a game apparatus are described that include a digital memory storage apparatus configured to store a plurality of musical recordings, wherein each musical recording includes a portion of a recording of a song wherein such song includes an identifiable and publicly-known title, a sound generation apparatus for broadcasting at least a portion of the plurality of musical recordings as mechanical waves, a controller controlling the broadcasting of the at least a portion of the plurality of musical recordings as mechanical waves, and a plurality of playing cards for game participants, each playing card including a matrix of song titles, each playing card including a different selection and orientation of the song titles, where the song titles included on the whole of the plurality of playing cards are the same as the publicly-known titles of the professional released recordings of songs defining the plurality of musical recordings.

17 Claims, 4 Drawing Sheets

GAME APPARATUS AND METHOD OF CONDUCTING A GAME

CLAIM OF PRIORITY

This non-provisional application claims priority to U.S. provisional patent application No. 61/513,309 entitled "Game Apparatus and Method of Conducting A Game" to Michael Joseph Shortino, filed on Jul. 29, 2011.

FIELD

This disclosure relates to the field of games. More particularly, this disclosure relates to a game of associating songs with song titles.

BACKGROUND

The traditional game of BINGO includes a card having various number arranged in a matrix. An announcer calls out letter and number combinations, and the first player to match a set of number according to a designated pattern wins.

Music is often an important source of entertainment at social gatherings. Unfortunately, the classic game of BINGO is usually required to be played in substantial silence to allow players to hear the numbers being called out by an announcer during a BINGO game.

What is needed, therefore, is a modern version of the classic BINGO game that combines music with the traditional game of BINGO.

SUMMARY

The above and other needs are met by a game apparatus as described herein. The game apparatus includes a digital memory storage apparatus configured to store a plurality of musical recordings, wherein each musical recording includes a portion of a professional released recording of a song wherein such song includes an identifiable and publicly-known title, a sound generation apparatus for broadcasting at least a portion of the plurality of musical recordings as mechanical waves, a controller controlling the broadcasting of the at least a portion of the plurality of musical recordings as mechanical waves, and a plurality of playing cards for game participants, each playing card including a matrix of song titles, each playing card including a different selection and orientation of the song titles, where the song titles included on the whole of the plurality of playing cards are the same as the identifiable and publicly-known titles of the professional released recordings of songs defining the plurality of musical recordings.

In one example, the game apparatus further includes a printer in communication with the controller, the printer for printing the plurality of playing cards for game participants. In another example, the plurality of musical recordings includes a first plurality of musical recordings, all from a first genre of music, and the game apparatus further includes a second plurality of musical recordings, all from a second genre of music.

In yet another example, the sound generation apparatus further includes a built-in sound system of a non-mobile facility.

In one example, the controller further includes a microprocessor.

In another example, the matrix of song titles is configured two-dimensionally ranging from a 4×4 matrix to an 8×8 matrix. In yet another example, each individual musical recording consists essentially of a song snippet. In another example, each of the song snippets has a duration ranging from about ten seconds to about fifty seconds.

In another aspect, examples of the disclosure provide a game apparatus including a digital memory storage apparatus configured to store a plurality of musical recordings, wherein each musical recording includes a portion of a professional released recording of a song wherein such song includes an identifiable and publicly-known title; a sound generation apparatus for broadcasting at least a portion of the plurality of musical recordings as mechanical waves; a controller controlling the broadcasting of the at least a portion of the plurality of musical recordings as mechanical waves; and a plurality of portable monitors, each portable monitor including a screen, wherein images of playing cards for game participants are displayed on or through the screens of the portable monitors, each playing card image including a matrix of song titles, each playing card image including a different selection and orientation of the song titles, where the song titles included on the whole of the plurality of images of the playing cards are the same as the identifiable and publicly-known titles of the professional released recordings of songs defining the plurality of musical recordings.

In one example, the game apparatus further includes a printer in communication with the controller, the printer for printing a plurality of playing cards for game participants, each playing card including a matrix of song titles, each playing card including a different selection and orientation of the song titles, where the song titles included on the whole of the plurality of playing cards are the same as the identifiable and publicly-known titles of the professional released recordings of songs defining the plurality of musical recordings.

In yet another aspect, examples of the disclosure provide a method of conducting a game. The method of conducting the game includes the steps of: (a) distributing a plurality of playing cards for game participants, each playing card including a matrix of song titles, each playing card including a different selection and orientation of the song titles; (b) broadcasting at least a portion of a plurality of musical recordings as mechanical waves wherein each of the musical recordings includes a professional released recording having a publicly-known title; and (c) pausing the game after a game participant correctly identifies a minimum number of musical recordings corresponding to song titles aligned either in horizontal, vertical, or diagonal orientation across the matrix on the game participant's playing card after such musical recordings have been broadcasted.

In one example, the method of conducting a game further includes the step of (d) rewarding a game participant who first correctly identifies a minimum number of musical recordings corresponding to song titles aligned either in horizontal, vertical, or diagonal orientation across the matrix on the game participant's playing card after such musical recordings have been broadcasted.

In another example, the method of conducting a game further includes the step of (e) rewarding a game participant who first correctly identifies a minimum number of musical recordings corresponding to song titles aligned either in horizontal, vertical, or diagonal orientation across the matrix on the game participant's playing card at least twice on the game participant's playing card after such musical recordings have been broadcasted.

In yet another example, the method of conducting a game further includes the step of (f) rewarding a game participant who first correctly identifies all of the musical recordings corresponding to the song titles on the game participant's playing card.

In another example, the method of conducting a game further includes the step of (d) providing a Web page for each venue that provides the game wherein a cumulative point system for game participants that correctly identify a minimum number of musical recordings corresponding to song titles aligned either in horizontal, vertical, or diagonal orientation across the matrix on the game participants' respective playing card after such musical recordings have been broadcasted are maintained.

In yet another example, the method of conducting a game further includes the steps of: (e) providing a Website on which the Web pages of step d. are maintained; and (f) providing a grand prize on a chronological basis based on a plurality of defined time periods wherein the grand prize is awarded to the game participant with the most cumulative points at the end of an applicable time period.

In another example, the distributing step includes distributing a plurality of playing cards for game participants by sending a signal including playing card image information, receiving the signal at each portable monitor, and generating an image of a playing card on the screen of each portable monitor; wherein each playing card image includes a matrix of song titles, each playing card image including a different selection and orientation of the song titles.

BRIEF DESCRIPTION OF THE DRAWINGS

Further features, aspects, and advantages of the present disclosure will become better understood by reference to the following detailed description, appended claims, and accompanying figures, wherein elements are not to scale so as to more clearly show the details, wherein like reference numbers indicate like elements throughout the several views, and wherein:

FIG. 2 shows an exemplary representation of what a playing card or an image of a playing card might look like;

DETAILED DESCRIPTION

Figure 1:
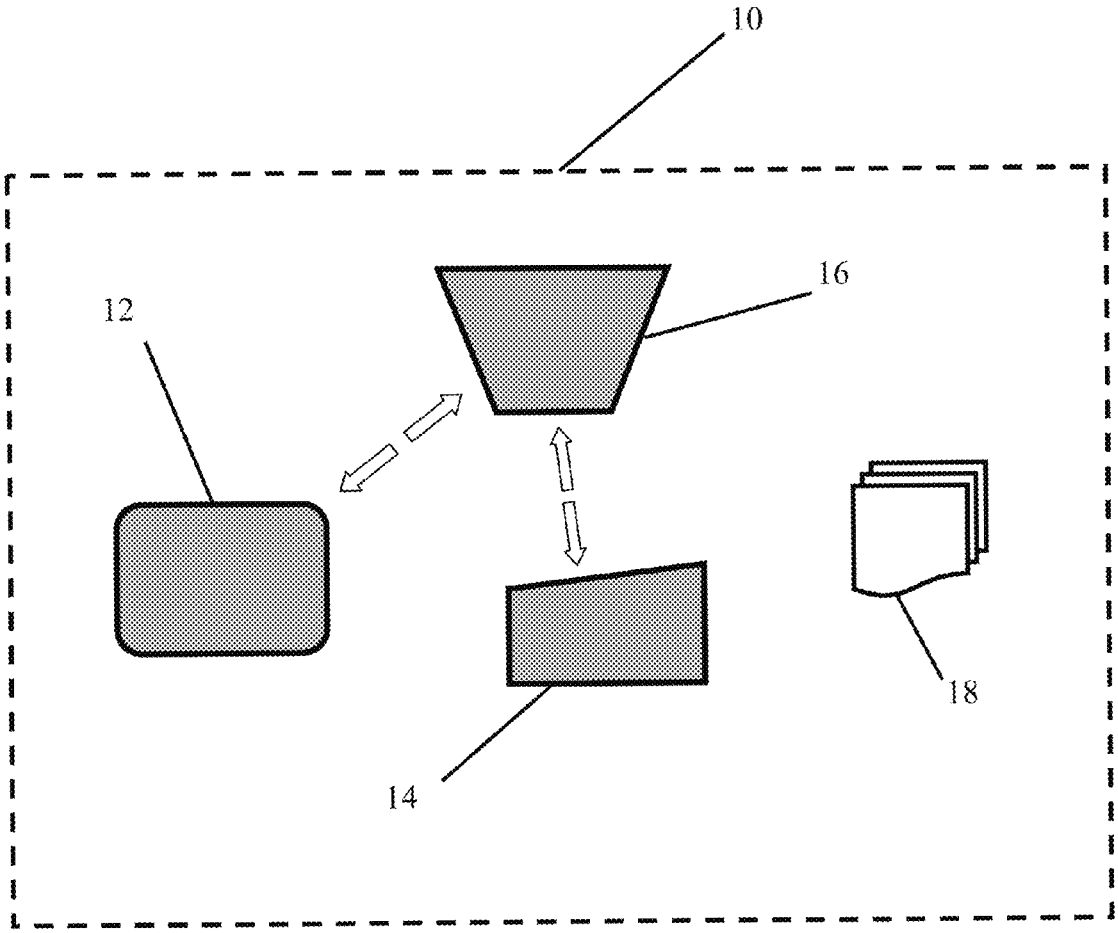
FIG. 1 shows a schematic diagram showing an embodiment of a game apparatus as described in the disclosure.
Figure 2:
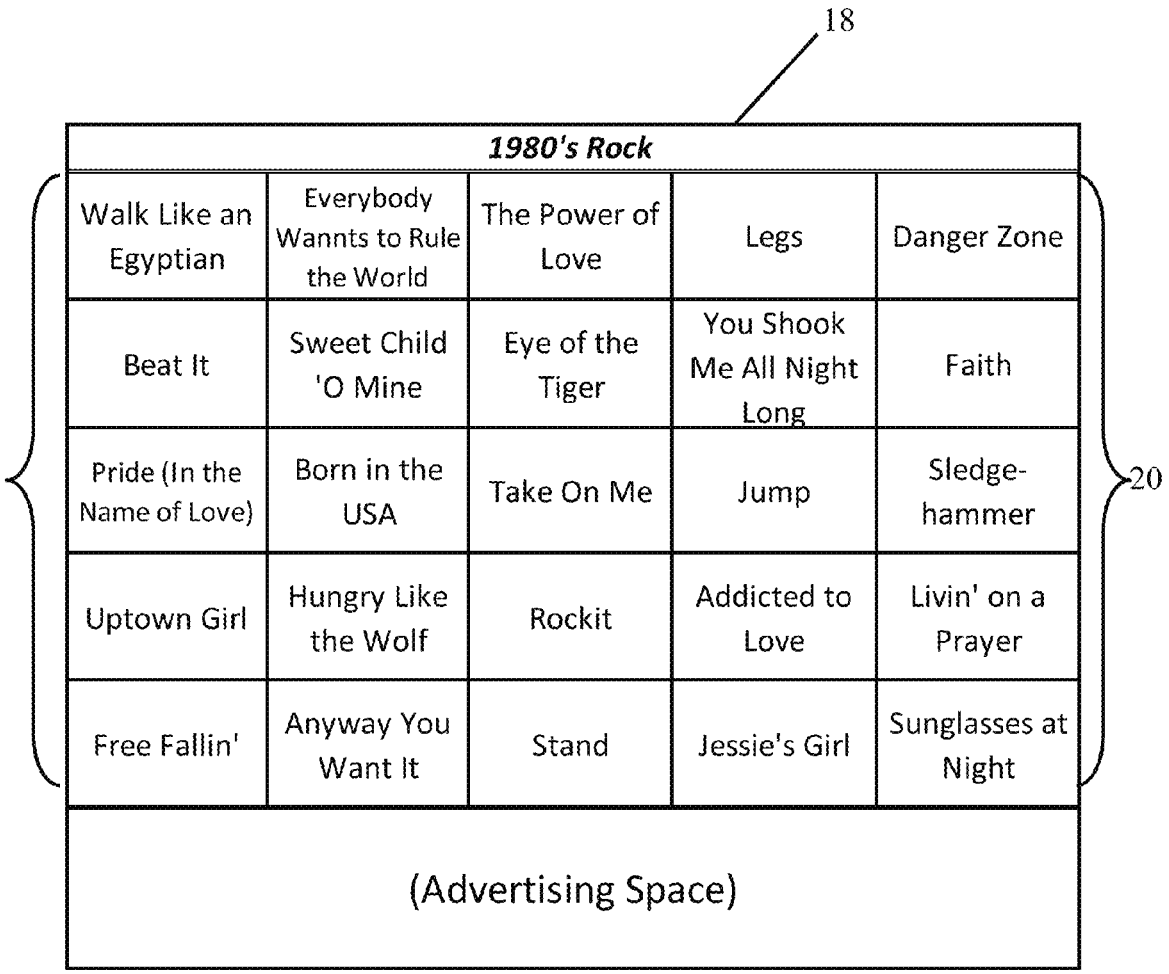

A game is disclosed that uses the underlying premise of the classic game known as BINGO and improves upon such game in a number of ways. FIG. 1 depicts a first embodiment of a game apparatus 10 including a digital memory storage apparatus 12 configured to store a plurality of musical recordings. Each musical recording preferably includes a portion of a professional released recording of a song wherein such song includes an identifiable and publicly-known title. The game apparatus 10 further includes a sound generation apparatus 14 for broadcasting at least a portion of the plurality of musical recordings as mechanical waves. The sound generation apparatus 14 can include a simple computer speaker (external or built-in), a portable amplifier and loudspeaker, a sound system built-in to a vehicle, a sound system built-in to a non-mobile facility (e.g., a building, an outdoor arena, a permanent tent structure), or any other apparatus for broadcasting a mechanical wave perceptible by humans. The game apparatus 10 also includes a controller 16 for controlling the broadcasting of the at least a portion of the plurality of musical recordings as mechanical waves. The controller could include, for example, a microprocessor or other similar device for managing and directing the audio files stored in the digital memory storage apparatus to be played through the sound generation apparatus. Preferably, the controller is in the form of a laptop computer, a tower computer, or a tablet personal computer or iPad. The game apparatus 10 also includes a plurality of playing cards 18 for game participants, each playing card including a matrix of song titles 20, each playing card including a different selection and orientation of the song titles, where the song titles included on the whole of the plurality of playing cards 18 are the same as the identifiable and publicly-known titles of the professional released recordings of songs defining the plurality of musical recordings. FIG. 2 shows an example of a playing card selected from a plurality playing cards. Preferably, the playing cards each include a matrix of song titles that includes 5×5 song titles, 7×7 song titles, or 9×9 song titles.

In one embodiment, the plurality of musical recordings includes a first plurality of musical recordings, all from a first genre of music. The game apparatus 10 further includes a second plurality of musical recordings, all from a second genre of music, stored on the digital memory storage apparatus 12. Theoretically, the game apparatus can include "n" pluralities of musical recordings from "n" genres of music, wherein "n" represents an ordinal number. In one embodiment, each plurality of musical recordings includes 75 song snippets included as discrete audio files that can be randomly "shuffled" using the controller 16 and associated proprietary software or otherwise. In other embodiments, pluralities of musical recordings preferably include from about 50 to about 150 song snippets. Song snippets preferably range in duration from about ten seconds to about fifty seconds and, more preferably, from about twenty-five seconds to about thirty-five seconds. In certain embodiments, different rounds within the same genre can be held in which the song snippets become shorter in duration relative to the degree of difficulty of the particular round. For example, a first round of song snippets from a particular genre can be about thirty seconds in duration, a second round of song snippets from the same genre can be about twenty seconds, and a third round of song snippets from the particular genre can be from about five seconds to about ten seconds in duration. Alternatively, the genres selected for each round can differ and, in certain embodiments in which the genres for different rounds differ, the durations of the song snippets can remain substantially the same. There are many variations in which the apparatus can be used.

Figure 3:
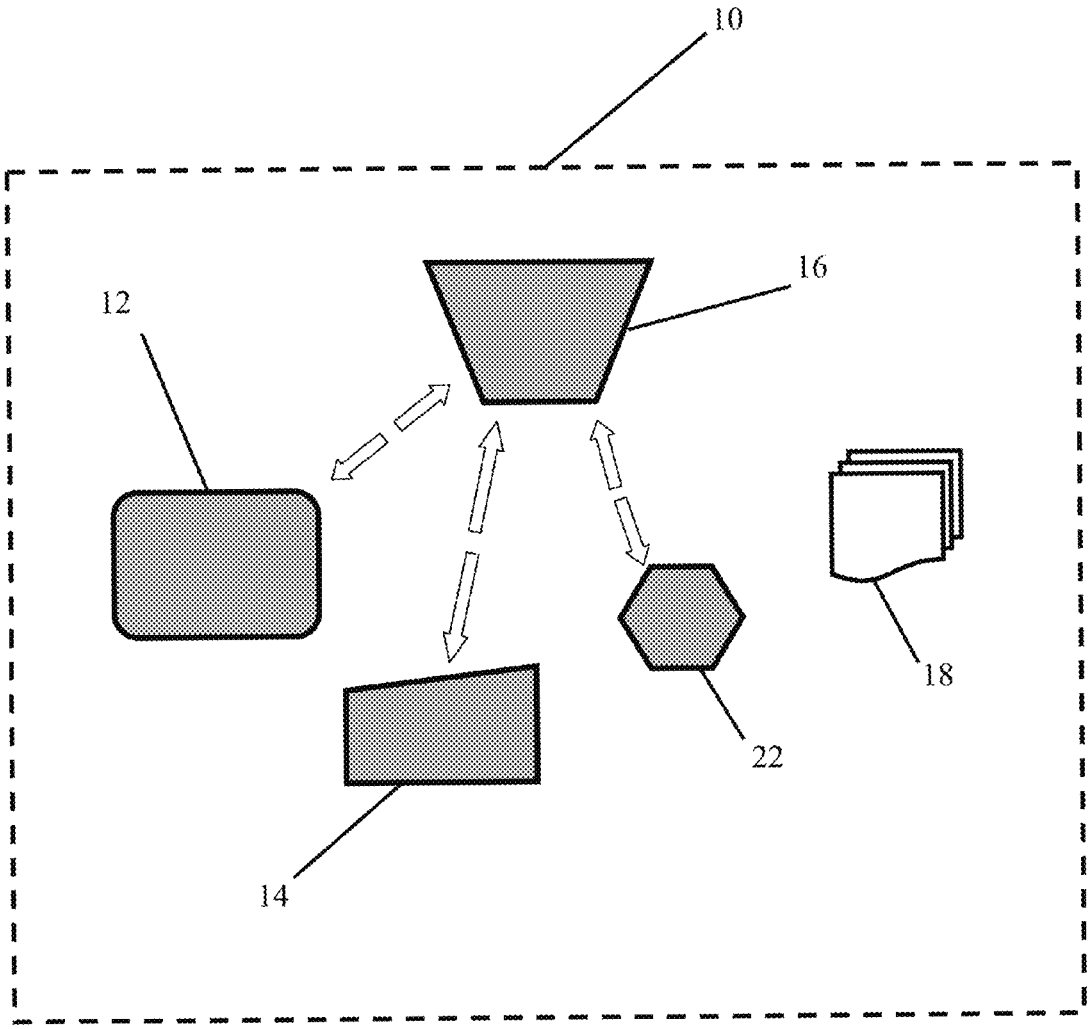
FIG. 3 shows a schematic diagram showing an embodiment of a game apparatus as described in the disclosure.

In one embodiment shown in FIG. 3, the game apparatus 10 includes a printer 22 in communication (e.g., by wire or wireless) with the controller 16. Prior to a game, the printer 22 can be used to print playing cards wherein the selection and combination of song titles on each playing card is different from all other playing cards that are printed. Additionally, the controller 16 can be configured to manually or automatically print advertising information on the playing cards for third party product and/or service providers based on, for example, a particular advertising payment plan agreed upon between third party product and/or service providers and the provider of the game apparatus and/or the venue hosting the game.

Figure 4:
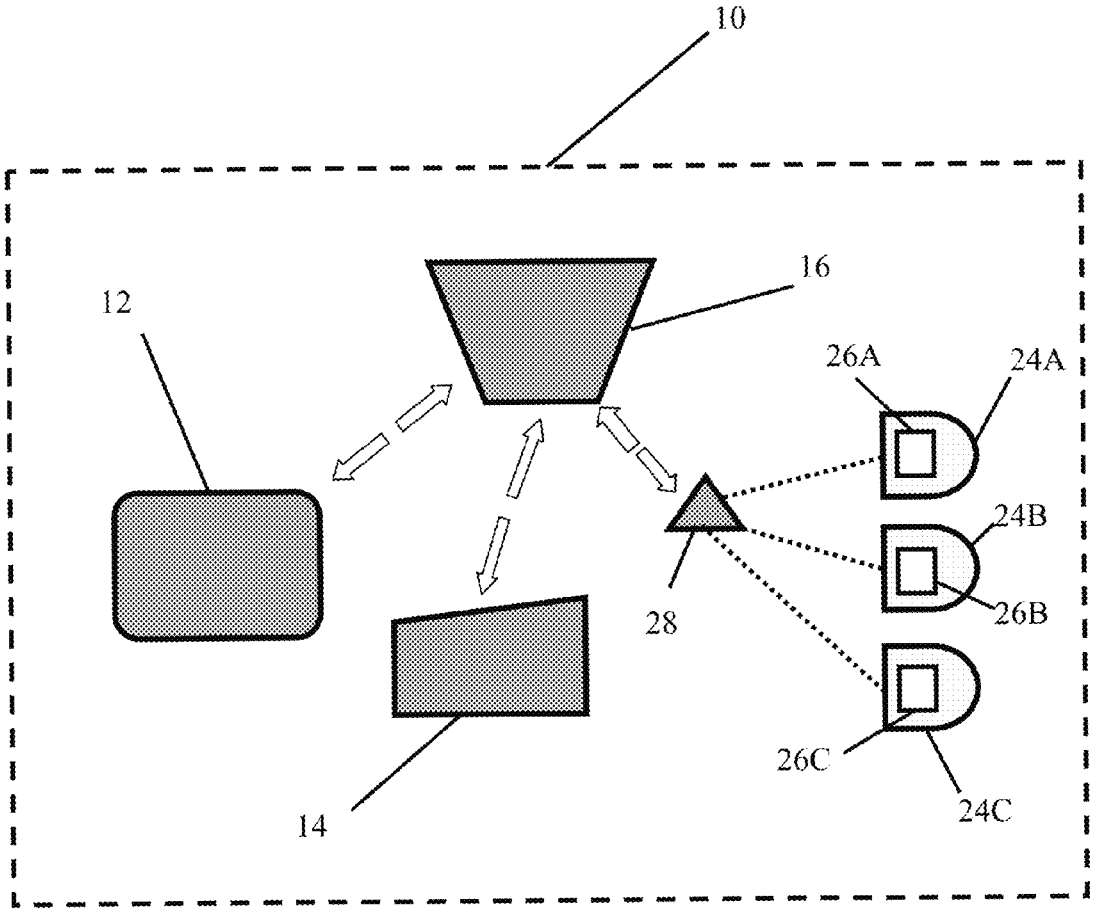
FIG. 4 shows a schematic diagram showing an embodiment of a game apparatus as described in the disclosure.

In another embodiment shown in FIG. 4, the game apparatus 10 includes a plurality of portable monitors (24A, 24B, and 24C) in communication (wired or wireless) with the controller 16. The portable monitors 24 each include a screen 26A on or through which an image of a playing card is displayed. Examples of portable monitors include, for example, relatively small computing devices such as, for example, tablet PCs or iPads, cellular telephones including a requisite application for synching with the controller, or other similar devices. Additionally, such application(s) can also provide a way for game participants to download playing cards as needed. The selection and orientation of the song titles displayed on each screen are managed by the controller 16 so that, preferably, no two portable monitors display the exact same selection and orientation of song titles. Between rounds of a game, the controller effectively "shuffles" the song titles and sends different images to the different screens of the portable monitors. The various playing card image configurations are preferably stored on the digital memory storage apparatus 12 and transmitted electrically, through electromagnetic waves, or otherwise to the portable monitors 24. If such transmission is wireless in nature, the game apparatus 10 includes one or more wireless transmitters 28 for transmitting the information wirelessly. In some cases, the controller 16 will already have a transmitter built in, so it will not always be necessary to have a separate transmitter as shown in FIG. 4.

In a preferred embodiment, the controller 16 is configured to manually or automatically send information to the portable monitors 24 so that the portable monitors can generate one or more displays of advertising for one or more product or service providers on the screens 26 of the portable monitors 24. The duration, size, and/or timing of such advertisements can be varied, for example, based on a particular advertising payment plan agreed upon between third party product and/or service providers and/or the provider of the game apparatus or the venue hosting the game.

In addition to the game apparatuses described herein, methods of conducting a game are also described. In one embodiment, a method of conducting a game includes the steps of (1) distributing a plurality of playing cards for game participants, each playing card including a matrix of song titles, each card including a different selection and orientation of the song titles; (2) broadcasting at least a portion of a plurality of musical recordings as mechanical waves wherein each of the musical recordings includes a professional released recording having a publicly-known title; and (3) pausing the game after a game participant indicates he or she has identified a minimum number of musical recordings corresponding to song titles aligned either in horizontal, vertical, or diagonal orientation across the matrix on the game participant's playing card after such musical recordings have been broadcasted. The step of "distributing" is broadly defined as active or passive dissemination of playing cards by any means including passing the playing cards out to game participants, placing the playing cards in one or more locations to be picked up by game participants, or providing playing card images on the screens of a plurality of portable monitors, wherein the portable monitors can be interactive or non-interactive (i.e., actual touchscreens sensitivity that interacts when a user touches the screen, highlighting a particular section of the matrix displayed thereon or, alternatively, a mere image with no such interactivity).

Some embodiments include the step of verifying the game participant referred to in step (3) has in fact correctly identified a minimum number of musical recordings that have been broadcasted, such musical recordings corresponding to song titles aligned either in horizontal, vertical, or diagonal orientation across the matrix on the game participant's playing card. Still other embodiments include the step of rewarding a game participant who first correctly identifies a minimum number of musical recordings corresponding to song titles aligned either in horizontal, vertical, or diagonal orientation across the matrix on the game participant's playing card after such musical recordings have been broadcasted. Certain embodiments further include one or both of the following steps: rewarding a game participant who first correctly identifies a minimum number of musical recordings corresponding to song titles aligned either in horizontal, vertical, or diagonal orientation across the matrix on the game participant's playing card at least twice on the game participant's playing card after such musical recordings have been broadcasted; and/or rewarding a game participant who first correctly identifies all of the musical recordings corresponding to the song titles on the game participant's playing card.

For embodiments in which portable monitors for displaying playing card images are included, additional method steps can include sending one or more signals with playing card image information (i.e., how the song titles should be arranged for a particular portable monitor), receiving the one or more signals at the portable monitors, and generating playing card images on or through the screens of the portable monitors. An additional step could include sending advertising information to the portable monitors and generating an image on or through the screens of the portable monitors to display the advertising information. For persons using their own portable monitors, a step of signing in to a game round may be necessary so that the playing card images generated for all participants are varied from one another (i.e., no one has the exact same playing card image in any one round).

In certain embodiments, the portions of musical recordings can be streamed directly from a cloud computing system through the World Wide Web or other similar system instead of the requirement that all such recordings be stored in a digital memory device. By using a cloud computing system, the amount of genres and musical recordings is virtually endless because such a system would not be limited by the memory capacity of a particular digital hard drive at the game location. This and other embodiments also allow a service provider that licenses the musical recordings and/or any applicable software to prevent a user from hosting or playing a game if certain minimum licensing fees have not been paid. Any embodiments utilizing streaming functionality would necessarily be interacting with a computer cloud through the World Wide Web or other similar system. When a request for streaming to a particular computer running the software for this method is sent, the user making the request can be automatically cross-checked on a database containing information on authorized licensees which would further indicate whether such authorized licensee has submitted proper timely payment for such services. If the authorized user's bill is not up to date, a message can be sent to the user requesting online payment via credit card, debit card, or other means before streaming will be allowed to commence to that particular controller. If the user is unauthorized (e.g., the request appears to be from a pirated set of software), the software can be remotely, preferably permanently, disabled.

In a related embodiment, a USB drive or other storage/key device can be provided to a licensee who wants to host a game wherein each particular storage/key device is uniquely identifiable and preferably will only work with properly licensed proprietary software which is preferably encrypted to prevent it from being pirated. (Similarly, preferably in all embodiments described herein, the snippets are also all encrypted so that they can only be played on the proprietary software.) In such an embodiment, musical recordings can only be broadcasted after a storage/key device provided to a user/host is authenticated by the proprietary software operating on the controller. In a preferred embodiment, if the controller is connected to the World Wide Web, the authenticated user's payment history can be automatically cross referenced before the user/host is allowed to continue with hosting a game. If the user/host's payments are overdue, the user/host can be required to make up any overdue license payments for the software or other intellectual property rights prior to continuing with hosting a game. In cases wherein an Internet or other connectivity for this type of monitoring is not available, even if a user/host has a storage/key device and a digital memory device with snippets saved thereon, he or she cannot broadcast the snippets unless and until the storage/key device is engaged with a controller that is operating using the requisite proprietary software. So, in certain embodiments, the software is configured to log the payment status of any license or other fees due every time a connection to the World Wide Web is established and maintain the last data log in memory. If a user/host is late on any applicable license payments during the last time he or she had the controller running the software connected to the Web, the software can prevent the user/host from hosting a game offline until he or she pays any outstanding balance to the applicable licensor(s).

In other embodiments, method steps further include providing a Web page for each venue that provides the game wherein a cumulative point system for game participants that correctly identify a minimum number of musical recordings corresponding to song titles aligned either in horizontal, vertical, or diagonal orientation across the matrix on the game participants' respective playing card after such musical recordings have been broadcasted are maintained. Such methods ca further include the steps of providing a Website on which the Web pages of step d. are maintained; and providing a grand prize on a chronological basis based on a plurality of defined time periods wherein the grand prize is awarded to the game participant with the most cumulative points at the end of an applicable time period. A "defined time period" could be, for example, every 90 days, every three months, every month, or other time period set by those responsible for rewarding game participants.

The previously described embodiments of the present disclosure have many advantages, including providing apparatuses and methods for attracting people to venues that typically host karaoke, trivia contests, live music, or recorded music to provide a more interactive game utilizing desirable features of all of the aforementioned activities. Certain embodiments allow game participants to use their own devices (e.g., cellular telephones, tablet PCs, iPads, and the like) to synchronize or otherwise communicate with a controller that provides images of playing cards to such devices. If portable monitors are unavailable or malfunction, embodiments including a printer allow for playing cards to quickly be printed out for game participants on site. These are but a few of the advantages and unique features of the embodiments described herein and are not meant to be limiting in any way.

The foregoing description of preferred embodiments of the present disclosure has been presented for purposes of illustration and description. The described preferred embodiments are not intended to be exhaustive or to limit the scope of the disclosure to the precise form(s) disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the concepts revealed in the disclosure in various embodiments and with various modifications as are suited to the particular use contemplated. All such modifications and variations are within the scope of the disclosure as determined by the appended claims when interpreted in accordance with the breadth to which they are fairly, legally, and equitably entitled.

What is claimed is:

1. A game apparatus comprising:

a. a digital memory storage apparatus configured to store a plurality of musical recordings, wherein each musical recording includes a portion of a professional released recording of a song wherein such song includes an identifiable and publicly-known title;

b. a sound generation apparatus for broadcasting at least a portion of the plurality of musical recordings as mechanical waves;

c. a controller controlling the broadcasting of the at least a portion of the plurality of musical recordings as mechanical waves; and d. a plurality of playing cards for game participants, each playing card including a matrix of song titles, each playing card including a different selection and orientation of the song titles, where the song titles included on the whole of the plurality of playing cards are the same as the identifiable and publicly-known titles of the professional released recordings of songs defining the plurality of musical recordings.

2. The game apparatus of claim 1 further comprising a printer in communication with the controller, the printer for printing the plurality of playing cards for game participants.

3. The game apparatus of claim 1 wherein the plurality of musical recordings comprises a first plurality of musical recordings, all from a first genre of music, and wherein the game apparatus of claim 1 further comprises a second plurality of musical recordings, all from a second genre of music.

4. The game apparatus of claim 1 wherein the sound generation apparatus further comprises a built-in sound system of a non-mobile facility.

5. The game apparatus of claim 1 wherein the controller further comprises a microprocessor.

6. The game apparatus of claim 1 wherein the matrix of song titles is configured two-dimensionally ranging from a 4×4 matrix to an 8×8 matrix.

7. The game apparatus of claim 1 wherein each individual musical recording consists essentially of a song snippet.

8. The game apparatus of claim 7 wherein each of the song snippets has a duration ranging from about ten seconds to about fifty seconds.

9. A game apparatus comprising:

a. a digital memory storage apparatus configured to store a plurality of musical recordings, wherein each musical recording includes a portion of a professional released recording of a song wherein such song includes an identifiable and publicly-known title;

b. a sound generation apparatus for broadcasting at least a portion of the plurality of musical recordings as mechanical waves;

c. a controller controlling the broadcasting of the at least a portion of the plurality of musical recordings as mechanical waves; and d. a plurality of portable monitors, each portable monitor including a screen, wherein images of playing cards for game participants are displayed on or through the screens of the portable monitors, each playing card image including a matrix of song titles, each playing card image including a different selection and orientation of the song titles, where the song titles included on the whole of the plurality of images of the playing cards are the same as the identifiable and publicly-known titles of the professional released recordings of songs defining the plurality of musical recordings.

10. The game apparatus of claim 9 further comprising a printer in communication with the controller, the printer for printing a plurality of playing cards for game participants, each playing card including a matrix of song titles, each playing card including a different selection and orientation of the song titles, where the song titles included on the whole of the plurality of playing cards are the same as the identifiable and publicly-known titles of the professional released recordings of songs defining the plurality of musical recordings.

11. A method of conducting a game, such method comprising the steps of:

a. distributing a plurality of playing cards for game participants, each playing card including a matrix of song titles, each playing card including a different selection and orientation of the song titles;

b. broadcasting at least a portion of a plurality of musical recordings as mechanical waves wherein each of the musical recordings includes a professional released recording having a publicly-known title;

c. pausing the game after a game participant correctly identifies a minimum number of musical recordings corresponding to song titles aligned either in horizontal, vertical, or diagonal orientation across the matrix on the game participant's playing card after such musical recordings have been broadcasted.

12. The method of conducting a game of claim 11 further comprising the step of d. rewarding a game participant who first correctly identifies a minimum number of musical recordings corresponding to song titles aligned either in horizontal, vertical, or diagonal orientation across the matrix on the game participant's playing card after such musical recordings have been broadcasted.

13. The method of conducting a game of claim 12 further comprising the step of e. rewarding a game participant who first correctly identifies a minimum number of musical recordings corresponding to song titles aligned either in horizontal, vertical, or diagonal orientation across the matrix on the game participant's playing card at least twice on the game participant's playing card after such musical recordings have been broadcasted.

14. The method of conducting a game of claim 13 further comprising the step of f rewarding a game participant who first correctly identifies all of the musical recordings corresponding to the song titles on the game participant's playing card.

15. The method of conducting a game of claim 12 further comprising the step of:

d. providing a Web page for each venue that provides the game wherein a cumulative point system for game participants that correctly identify a minimum number of musical recordings corresponding to song titles aligned either in horizontal, vertical, or diagonal orientation across the matrix on the game participants' respective playing card after such musical recordings have been broadcasted are maintained.

16. The method of conducting a game of claim 12 further comprising the step of:

e. providing a Website on which the Web pages of step d. are maintained; and f. providing a grand prize on a chronological basis based on a plurality of defined time periods wherein the grand prize is awarded to the game participant with the most cumulative points at the end of an applicable time period.

17. The method of conducting a game of claim 11 wherein the distributing step comprises distributing a plurality of playing cards for game participants by sending a signal including playing card image information, receiving the signal at each portable monitor, and generating an image of a playing card on the screen of each portable monitor;

wherein each playing card image includes a matrix of song titles, each playing card image including a different selection and orientation of the song titles.

* * * * *